US005121094A

United States Patent [19]

Ting et al.

[11] Patent Number: 5,121,094

[45] Date of Patent: Jun. 9, 1992

[54] DUAL CONDITION RESPONSIVE SWITCH APPARATUS

[75] Inventors: Youn H. Ting; Werner Strasser, both of Lexington; Richard T. Gordon; John T. Hancock, both of Versailles; Bryan C. Jansen, Lexington, all of Ky.; John A. Haug, North Attleboro, Mass.

[73] Assignee: Texas Instruments Incorporated, Dallas, Tex.

[21] Appl. No.: 742,131

[22] Filed: Aug. 8, 1991

Related U.S. Application Data

[63] Continuation-in-part of Ser. No. 661,764, Feb. 26, 1991, abandoned.

[51] Int. Cl.[5] ..... H01H 37/00; H01H 37/52; H01H 35/40

[52] U.S. Cl. ..... 337/2; 337/300; 337/354; 200/83 P

[58] Field of Search ..... 337/2, 3, 1, 298, 299, 337/300, 354, 365, 370, 371, 372, 380; 200/83 P

[56] References Cited

U.S. PATENT DOCUMENTS

| | | | |
|---|---|---|---|
| 3,500,277 | 3/1970 | Nardulli | 337/343 |
| 3,582,853 | 6/1971 | Morris | 337/354 |
| 4,757,165 | 7/1988 | Marcoux et al. | 200/83 P |
| 4,794,214 | 12/1988 | Sanford | 200/83 P |
| 4,948,931 | 8/1990 | Nixon et al. | 200/83 P |

*Primary Examiner*—Harold Broome

*Attorney, Agent, or Firm*—Russell E. Baumann; Richard L. Donaldson; René E. Grossman

[57] ABSTRACT

An electric switch is shown which is responsive separately to two different conditions, i.e. temperature and pressure. The switch includes a temperature sensing disc and a pressure sensing disc both coupled through several alternate motion transfer arrangements to the movable electrical contact of the switch. Several structures are shown for mounting a switch on a surface so that the pressure sensing disc is exposed to fluid pressure and the temperature sensing disc is thermally coupled to the surface.

16 Claims, 5 Drawing Sheets

DUAL CONDITION RESPONSIVE SWITCH APPARATUS

This application is a CIP of Ser. No. 07/661,764, now abandoned.

BACKGROUND OF THE INVENTION

This invention relates generally to electric switches and more specifically to electric switches which are responsive separately to two different conditions.

In many mechanical and electrical apparatus sensors are utilized to monitor and respond to various conditions to ensure proper operation of the apparatus and prevent unsafe or undesirable operation thereof. For example, in refrigerator compressors it is common practice to provide a pressure responsive electric switch such as that shown and described in U.S. Pat. No. 3,584,168, assigned to the assignee of the present invention. In that patent a switch is described having a port fitting adapted to be attached to a pressure source so that when the pressure rises to a predetermined level a diaphragm snaps from a convex to a concave configuration transmitting its motion through a motion transfer pin to a movable contact arm of the switch to either open or close an electric circuit.

It is also common practice to mount a temperature responsive electric switch in heat transfer relationship with selected portions of a compressor apparatus such as the compressor shell. For example, a temperature responsive electric switch of this type is shown and described in U.S. Pat. No. 3,416,115 also assigned to the assignee of the present invention. In that patent a switch is described having a snap acting thermostatic disc thermally coupled to a thermally conductive surface which in turn is mounted in heat transfer relation with a surface whose temperature is being monitored, i.e. the compressor shell. The disc is adapted to move from a first convex or concave configuration to the opposite concave, convex configuration, upon reaching a selected temperature with its motion transferred through a motion transfer pin to a movable contact arm of the switch to either open or close an electrical circuit.

SUMMARY OF THE INVENTION

It is an object of the present invention to provide an electric switch which will respond separately to two different conditions such as pressure and temperature.

Another object of the invention is the provision of an electric switch responsive separately to two different conditions which is reliable yet economical to produce.

Briefly, in accordance with the invention, an electric switch having stationary and movable contact means is mounted in a cavity formed in a base member. A motion transfer pin guide is received on the base and is provided with a recess formed on an outer surface to accommodate a first, snap acting disc such as a thermostatic disc. A motion transfer pin is slidably mounted in a bore of the guide between the first disc and the movable contact means. The base and guide are received in a tubular metallic housing which is hermetically attached to a second snap acting disc, such as a pressure responsive diaphragm, and an annular disc support. A second pin is received in the bore of the annular support and extends between the diaphragm and the first disc.

According to a feature of the invention a disc retainer is mounted on the pin guide and extends into the recess a selected distance such that the first disc, in its normal unactuated convex configuration, is permitted to move freely between the floor of the recess and the disc retainer.

The housing is formed with a pressure port so that the diaphragm can be placed in direct communication with a fluid pressure source. In operation, when the pressure increases to a selected level the second disc or diaphragm will move from its unactuated convex configuration to an opposite concave configuration transferring its motion through the second pin to the first disc. Since the first disc is free to move within its prescribed limits it moves against the first pin and transfers motion to the movable contact means to open the switch circuit. Independently of changes in pressure, if the temperature of the first disc increases to a selected level it will snap from its normal, unactuated convex configuration to the concave configuration with its outer periphery reacting against the disc retainer and the center of the disc transferring its motion through the first pin to the movable contact means to open the switch circuit.

According to other features of the invention several embodiments are shown to thermally couple the thermostatic disc with the compressor shell including extending the housing and forming it into a tubular port configuration for direct attachment to an aperture in the compressor shell and extending the housing or pressure disc support outwardly to form a welding plate for direct attachment to the compressor shell. Another embodiment shows an outward extension on a portion of the housing removed from the pressure sensor to minimize potential deleterious affects on calibration caused by heat associated with welding of the switch housing to the compressor shell.

An alternative embodiment employs concentric motion transfer pin members comprising a solid pin slidably mounted within a tubular pin which in turn is slidably mounted in a bore of a guide member. The solid pin extends between a pressure disc and the movable contact means through an aperture in the thermostatic disc and the tubular pin extends between the thermostatic disc and the movable contact means.

According to another feature of the invention the pressure sensing function may be accomplished with a single pressure disc or a stack of several pressure discs depending upon the desired actuation pressures.

Another alternative embodiment is particularly adapted for use to be responsive to low pressure or partial vacuum conditions as well as to temperature conditions. In this embodiment the pressure responsive disc in its normal condition is bowed inwardly maintaining the movable contact, through a temperature responsive disc assembly, in the closed condition. Upon a selected decrease in sensed pressure, e.g. upon being exposed to a selected partial vacuum, the disc will snap outwardly causing the spring bias in the movable contact arm to open the switch. In the event temperature increases to a selected level the temperature responsive disc will snap which will also allow the spring bias in the movable arm to open the switch.

BRIEF DESCRIPTION OF THE DRAWINGS

The above mentioned and other features and objects of this invention and the manner of attaining them will become more apparent and the invention itself will be better understood by reference to the following description of several preferred embodiments of the invention taken in conjunction with the accompanying drawings, wherein.

DETAILED DESCRIPTION OF THE PREFERRED EMBODIMENT

Figure 1:
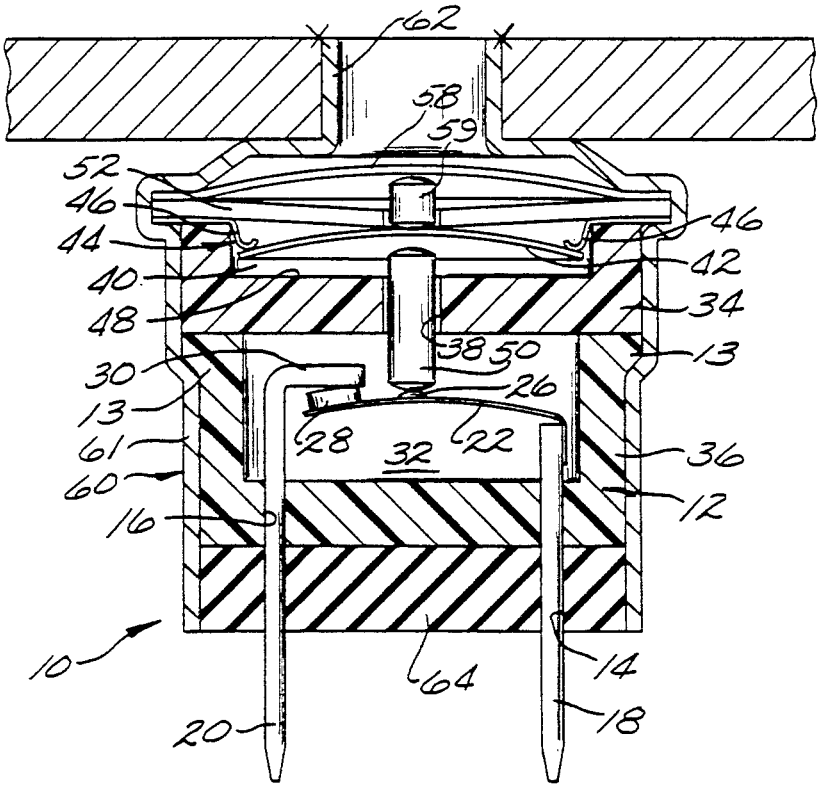
FIG. 1 is a cross section taken through a dual condition responsive switch made in accordance with a first embodiment of the invention.

Referring to FIG. 1, switch 10 comprises a cylindrical cup shaped base member 12 formed of a conventional molded electrically insulative material, and is formed with apertures 14, 16 for reception therein of terminal members 18 and 20 respectively. Movable contact arm 22 formed of electrically conductive material having good spring characteristics, such as beryllium copper, is cantilever mounted to the free distal end of terminal 18 in any conventional manner as by welding. Arm 22 is preferably formed with a dimple 26 for engagement with a motion transfer pin to be described below. Arm 22 mounts on its free end a movable contact 28 which is normally biased into engagement with the distal end portion 30 of terminal 20 which end portion is bent approximately 90° to extend into the cavity 32 formed within base member 12.

A generally circular pin guide 34 of suitable electrically insulative material is disposed on the free distal end of the base member sidewall 36. A bore 38 is formed through pin guide 34 in alignment with dimple 26 of movable contact arm 22. Pin guide 34 also has a recess 40 formed therein for reception of a temperature responsive thermostatic disc 42. A thermally conductive disc retainer 44 is received on the annular shaped top surface of pin guide 34 and is also shaped as an annulus having disc retaining feet 46 depending down into the recess at a plurality of locations around the outer periphery of the recess to define an upward limit of the motion of disc 42 which can move from and to floor 48 of the recess. It will be appreciated that feet 46 could be a continuous circular member as well as a plurality of discrete feet.

A first or lower pin 50 is slidably received in bore 38 and extends generally between dimple 26 and thermostatic disc 42.

An annular pressure disc support 52 of suitable weldable and bendable material such as steel, is disposed on top of disc retainer 44 and has a bore 54. Support 52 is bent into a saucer shaped configuration a selected amount to permit diaphragm 58 to move from the upwardly convex configuration shown in FIG. 1 to an opposite concave configuration. A pressure responsive diaphragm 58 of stainless steel or other suitable material is placed over the disc support 52 with a second or upper motion transfer pin 59 slidably received in bore 54. The diaphragm is formed into a snap acting disc by means known in the art; basically involving forming a curved surface by permanently deforming the diaphragm material.

Base member 12 and pin guide 34 are placed within a tubular, metallic housing 60 which is hermetically attached to the outer periphery of disc support 52 and pressure diaphragm 58 as by welding. Housing 60 is provided with a reduced section 61 which fits against an enlarged diameter portion 13 of base member 12 to lock the base member in one direction. The opposite direction is locked by means of the hermetic welding of the housing to the diaphragm and disc support. Housing 60 extends above pressure diaphragm 58 and terminates in an open tubular section 62 which is adapted to be inserted into an aperture of a compressor shell and attached to the shell as by welding with the pressure diaphragm 58 directly exposed to a fluid pressure source within the compressor shell and the temperature responsive disc 42 thermally coupled to the compressor shell via the thermally conductive path including housing 60, disc support 52 and disc retainer 44 as well as via the pressure fluid, pressure diaphragm 58 and disc support 44. Housing 60 extends below base member 12 to provide a well to receive epoxy 64 to provide an environmental seal for the switch cavity.

As noted above, the feet 46 of the disc retainer extend into recess 40 so that a selected distance is provided between feet 46 and floor 48. This distance is selected so that upon a selected increase in pressure exposed to diaphragm/disc 58 when the disc snaps from its upwardly convex configuration as shown in FIG. 1 to its oppositely configured, upwardly concave configuration (not shown) its motion will be transferred through upper pin 59 to temperature responsive disc 42 moving it toward the bottom of the recess and in turn moving lower pin 50 downwardly against dimple 26 to separate movable contact 28 from stationary contact 30.

In situations where the pressure does not increase to the selected level for actuating the pressure disc but the temperature of the temperature responsive disc increases to its actuation level through heat transferred to it from the compressor, disc 42 will snap from its upwardly convex configuration shown in FIG. 1 to its opposite, upwardly concave configuration with the outer peripheral portions of the disc reacting against feet 44 and the center of the disc transferring its motion through lower pin 50 to dimple 26 to cause movable contact 28 to move out of engagement with stationary contact 30.

Figure 2:
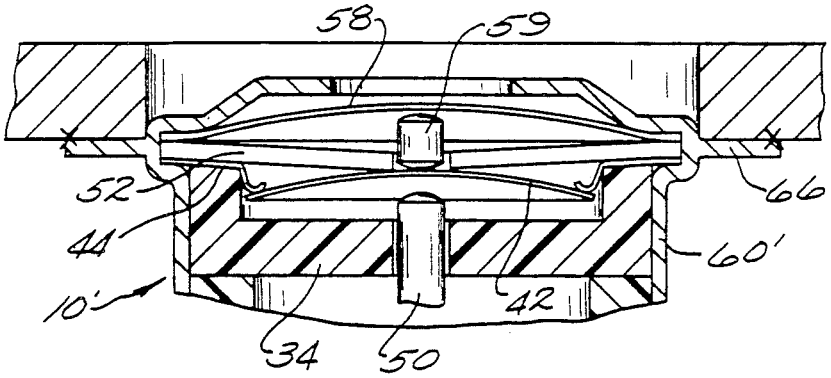
FIGS. 2 and 3 are cross sectional partial views of two alternate embodiments showing different mounting means.
Figure 3:
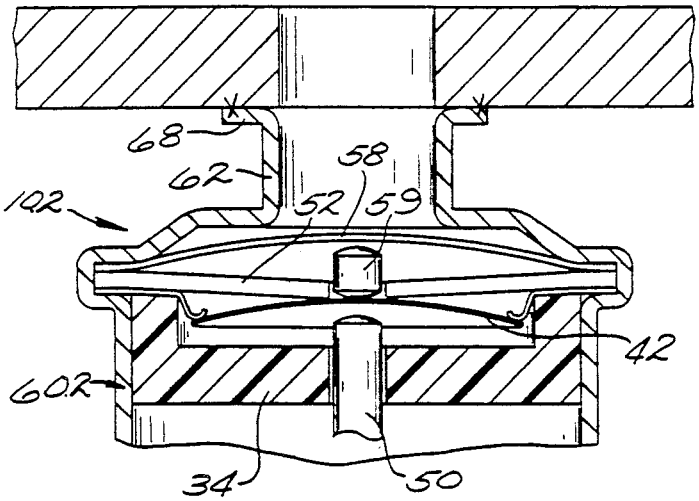

FIGS. 2 and 3 show alternative structure for attaching the switch to a compressor shell including a radially extending flange 66 projecting from housing 60.1 to facilitate welding of switch 10.1 to the compressor shell as shown in FIG. 2. As shown in FIG. 3, a radial flange 68 has been added to the open tubular section 62 of switch 10.2 which facilitates welding of switch 10.2 to the compressor shell.

Figure 4:
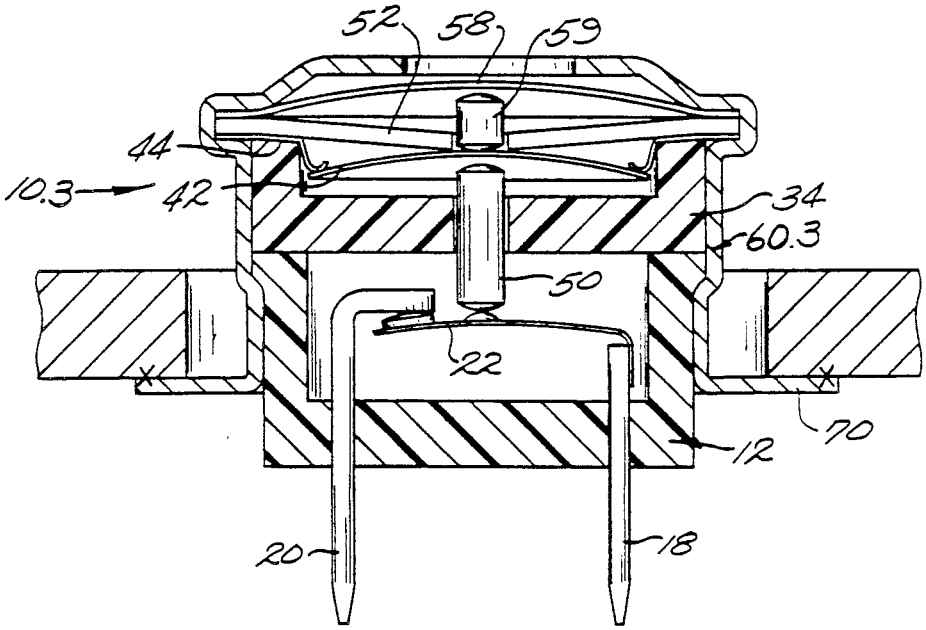
FIGS. 4 and 5 are cross sectional views of mounting means adapted to avoid potential pressure sensor calibration drift associated with mounting of the switch.
Figure 5:
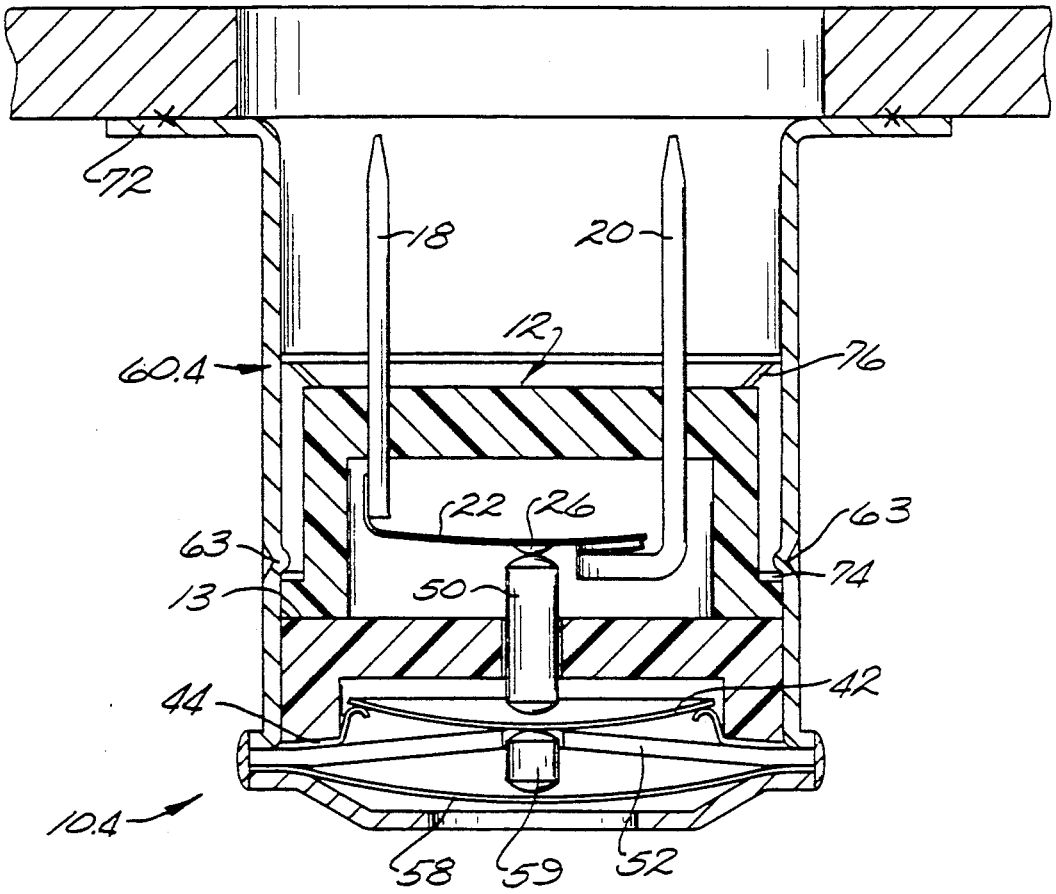

FIGS. 4 and 5 show yet other embodiments for mounting the switch to a compressor shell which provide the further advantage of isolating the heat of the welding operation when attaching the switch housing to the compressor shell, from the pressure sensing portion of the switch and thereby avoid possible calibration drifts which could occur upon being subjected to excessively high temperatures. In FIG. 4 housing 60.3 is provided with a radially extending flange 70 which extends from the housing below the transition between the full size diameter portion and the reduced diameter portion.

FIG. 5 shows switch 10.4 mounted entirely within the compressor shell with housing 60.4 extended beyond the bottom of base member 12 and terminating with outwardly extending radial flange 72 which is readily weldable to the compressor shell. Housing 60.4, preferably formed of cold rolled steel is provided with a plurality of detents 63 which cooperate with enlarged radius portion 13 of base member 12 and a locking spring 74 to prevent motion of base member 12 along with the hermetic welding of the pressure sensor portion of the switch. Clamp rings 76 may also be used if desired for locking the base member within the housing.

A switch made in accordance with FIG. 5 has a total height of 1.5 inches, the housing has an outer diameter of 1.25 inches and has the following characteristics:

| | | |
|---|---|---|
| Temperature | Open | 295 +/− 10° F. |
| | Close | 195 +/− 20° F. |
| Pressure | Open | 450 +/− 20 psig |
| | Close | 325 +/− 25 psig |

Figure 6:
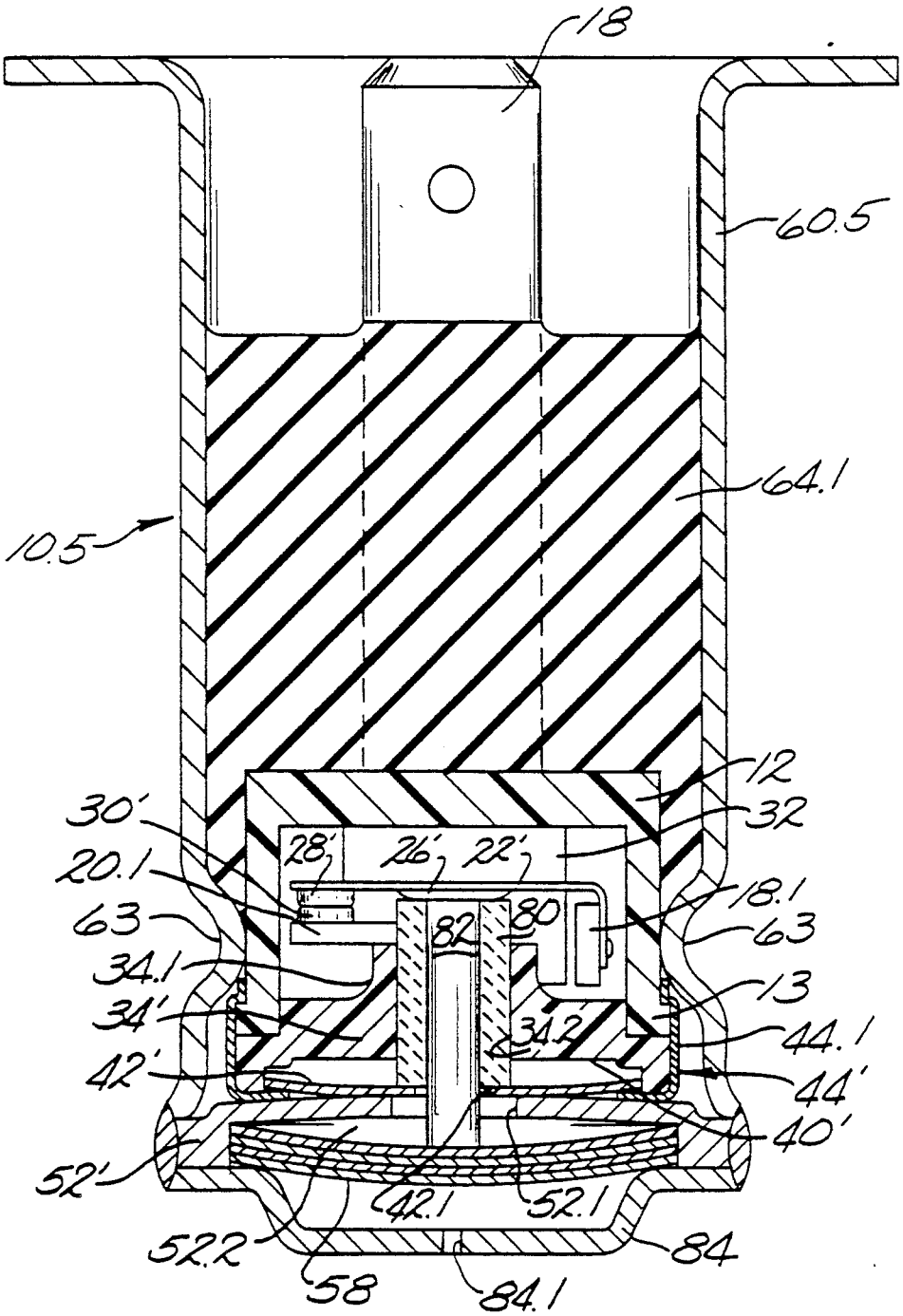
FIG. 6 is a cross sectional view taken through an alternative embodiment of a dual condition responsive switch.

With reference to FIG. 6 an embodiment is shown in which concentric motion transfer members are employed. Switch 10.5 comprises a cup shaped base member 12 defining a switch cavity 32, as described above, into which are received terminals 18, 20 (only terminal 18 being shown in the figure). A movable contact member 22′ is mounted at one end on support 18.1, attached to terminal 18, and mounts movable contact 28′ at an opposite end. Movable contact 28′ is adapted to go into and out of engagement with stationary contact 30′ which is mounted on stationary terminal 20.1 attached to terminal 20.

A motion transfer guide member 34′ is provided with a centrally located hub 34.1 through which a bore 34.2 extends. A recess 40′ is formed in the outer surface of guide member 34′ and receives therein a thermostatic disc 42′ having a centrally located aperture 42.1. Disc 42′ is retained in recess 40′ during assembly by a disc retainer member 44′ which is formed with a sidewall 44.1 to be discussed below. Disc retainer 44′ is constructed of heat conductive material such as aluminum and serves to conduct heat from housing 60.5 to heat responsive disc 42′.

A tubular motion transfer member 80 of suitable electrically insulative material such as ceramic having an outer diameter larger than the aperture in disc 42′ is slidably received in bore 34.2 and extends between movable contact member 22′ and temperature responsive disc 42′. Guide member 34′ is placed on the free distal end portion of the base member 12 sidewalls with sidewall 44.1 crimped beyond the enlarged portion 13 to secure the temperature sensing assembly to base 12.

Annular pressure disc support 52′ is provided with a centrally located bore 52.1 and is formed with a recess 52.2 adapted to receive a selected number of pressure responsive discs 58, the particular number of discs being dependent upon the desired actuation pressure. A single disc could be employed for relatively low actuation pressures or a stack of up to five or more discs could be used for higher pressures. A solid pin 82 of suitable electrically insulative material, preferably the same as member 80, is slidably inserted into tubular member 80 and extends between movable member 22′ and the pressure disc(s). It will be noted that pin 82 is somewhat longer than tubular member 80 in order to extend through bore 52.1 of annular member 52′ to the pressure disc(s). Movable member 22′ is preferably formed with a rib 26′ to engage members 80, 84. An outer cap 84 is received over recess 52.2 capturing the pressure responsive discs 58 therein and is welded to annular support 52′ and the lower end of housing 60.5 along their outer peripheries to form an hermetic seal. An aperture 84.1 in cap 84 provides communication between the pressure responsive disc and the pressure source to be monitored.

As in the FIG. 5 embodiment the housing is bent inwardly at selected locations 63 to lock the switch mechanism into housing 60.5. The FIG. 6 embodiment provides a motion transfer mechanism which is easy to assemble yet reliable in operation. It will be understood that the switching logic, i.e. normally closed v. normally open, can be inverted by placing the stationary contact member on the other side of the movable contact member.

Figure 7:
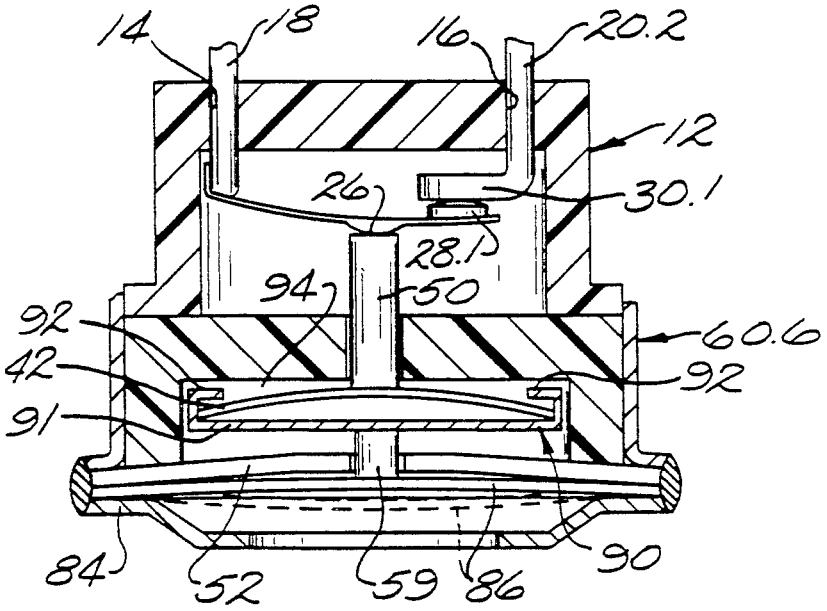
FIG. 7 is a cross sectional partial view of another alternative embodiment of a dual condition responsive switch.

With reference to FIG. 7 a pressure and temperature responsive switch particularly adapted for use in sensing low pressure conditions such as partial vacuum along with high temperature conditions is shown. The switch of FIG. 7 is a variation of that shown in FIGS. 1–5 with the differences discussed below. In this embodiment the switch is normally closed with pressure responsive disc 86 bowed inwardly against disc support 52 at pressures of a pressure source in communication with disc 86 above a selected level, for example above 12 psi. Should the pressure of the fluid media exposed to disc 86 fall below that level the disc will snap outwardly to the dashed line position shown in the figure.

Temperature responsive disc 42 is received in a cage 90 and retained therein by arms 92, the cage being adapted to move up and down, as seen in FIG. 7, within recess 94. As shown in the figure the disc, at temperatures below a selected level, has an inwardly convex configuration. Should the temperature of disc 42 increase to the selected level the disc will snap to its opposite inwardly concave position (not shown).

Under normal operating conditions of the system with which switch 10.6 is used with normal temperature and pressure conditions, pressure responsive disc 86 will bias pin 59 upwardly against bottom wall 91 of cage 90 biasing cage 90 and temperature responsive disc 42 upwardly which in turn, through pin 50, biases movable arm 22.1 upwardly thereby maintaining movable contact 28.1 in engagement with stationary contact 30.1. If the temperature of temperature responsive disc 42 increases to the selected level the disc will snap to its opposite configuration allowing the bias in movable arm 22.1 to move the arm downwardly along with pin 50 with the contacts moving into the contacts disengaged position. On the other hand if pressure decreases to a selected level, pressure responsive disc 86 will snap to its dashed line position allowing pin 59, and the temperature responsive disc assembly of disc 42 and cage 90 to move downwardly thereby allowing movable arm 22.1 to push pin 50 downwardly and concomitantly the contacts to move into the contacts disengaged position.

Figure 8:
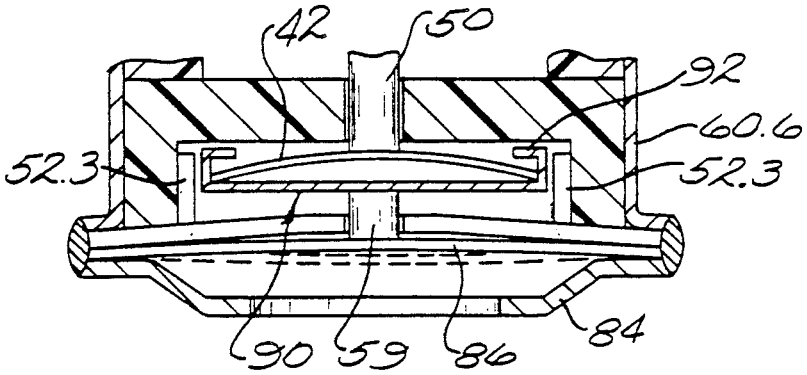
FIG. 8 is a cross sectional partial view of a variation of the FIG. 7 embodiment.

If desired the sensitivity of the temperature responsive disc assembly can be enhanced by improving the heat conductive path from housing 60.6 to the disc as by forming a plurality of spaced apart arms 52.3 shown in FIG. 8 from pressure disc support 52 and bending them upwardly to define the path of movement of cage 90 in close thermal coupling thereto.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. An electric switch responsive separately to temperature and to pressure comprising a switch base member defining a cavity, a stationary and a movable contact means mounted within the cavity of the switch base member, the movable contact means adapted to move into and out of engagement with the stationary contact means, a generally tubular metallic housing, at least a portion of the switch base member disposed within the housing, a pin guide received on the base member, the guide having a bore extending through the pin guide in alignment with the movable contact means, the pin guide having a recess formed on a surface thereof, a temperature responsive snap acting disc disposed in the recess, a first pin slidably received in the bore between the movable switch means and the disc, an annular pressure disc support having an outer periphery and a bore therethrough and a pressure responsive disc having an outer periphery, the outer periphery of the annular support and the pressure responsive disc hermetically coupled together and with the housing, a second pin disposed in the bore of the annular pressure disc support between the temperature responsive disc and the pressure responsive disc and means to mount the switch to a body whose temperature is to be monitored and in communication with a pressure source whose pressure is to be monitored.

2. An electric switch according to claim 1 including a temperature disc retainer extending into the recess formed on a surface of the pin guide to limit outward movement of the outer periphery of the temperature responsive disc.

3. An electric switch according to claim 2 in which the temperature disc retainer comprises an annular member received intermediate the pin guide and the pressure disc support.

4. An electric switch according to claim 1 in which the means to mount the switch to a compressor shell comprises an extended portion of the housing projecting above the pressure responsive disc and configured as a tubular portion.

5. An electric switch according to claim 1 in which the switch base member has a bottom wall with first and second slots formed therethrough, the movable and stationary switch means having first and second terminal members extending through the respective first and second slots, and the means to mount the switch to a compressor comprises an extended portion of the housing projecting beyond the first and second terminal members.

6. An electric switch according to claim 5 in which the extended portion of the housing is configured as a tubular portion having a distal end and an outwardly projecting flange is attached to the open end to facilitate attachment to the compressor shell.

7. An electric switch according to claim 1 in which the means to mount the switch to a compressor shell comprises a flange projecting outwardly from the housing.

8. An electric switch responsive separately to temperature and to pressure comprising a switch base member, a stationary and a movable contact means mounted on the switch base member, the movable contact means adapted to move into and out of engagement with the stationary contact means, a motion transfer guide member having a bore extending therethrough mounted on the base with the bore in alignment with the movable contact means, the guide member having a recess formed on a surface thereof, a temperature responsive snap acting disc disposed in the recess, a motion transfer member received in the bore extending between the movable switch means and the disc, an annular pressure disc support having an outer periphery and a bore therethrough and a pressure responsive disc having an outer periphery, the outer periphery of the annular support and the pressure responsive disc hermetically coupled together, means to mount the annular support and pressure responsive discs adjacent the base member, and means to couple the pressure responsive disc with the movable contact means through the bore in the annular pressure disc support whereby selected thermal conditions and pressure conditions will cause engagement and disengagement of the movable and stationary contacts independently of one another.

9. An electric switch responsive separately to temperature and to pressure according to claim 8 in which the means to couple the pressure responsive disc with the movable contact means includes a second motion transfer member slidably received in the bore of the annular pressure disc support and extending between the pressure responsive disc and the temperature responsive disc.

10. An electric switch responsive separately to temperature and to pressure according to claim 8 in which the motion transfer member is tubular and the means to couple the pressure responsive disc with the movable contact means includes a solid pin slidably received within the tubular motion transfer member and extending between the pressure responsive disc and the movable contact means.

11. An electric switch responsive separately to temperature and to pressure according to claim 8 in which a plurality of pressure responsive discs are coupled to the annular support member.

12. An electric switch responsive separately to temperature and to pressure according to claim 8 in which the temperature responsive disc is received in a cage having a bottom wall, the cage being movable within the recess toward and away from the movable contact means, the means to couple the pressure responsive disc with the movable contact means includes a second motion transfer member slidably received in the bore of the annular pressure disc support and extending between the pressure responsive disc and the bottom wall of the cage.

13. An electric switch responsive separately to temperature and to pressure according to claim 12 in which the cage includes retaining means to retain the temperature responsive disc in the cage.

14. An electric switch responsive separately to temperature and to pressure comprising a switch base member defining a cavity, a stationary and a movable contact means mounted within the cavity of the switch base member, the movable contact means adapted to move into and out of engagement with the stationary contact means, a pin guide received on the base member, the guide having a bore extending through the pin guide in alignment with the movable contact means, the pin guide having a recess formed on a surface thereof, a movably mounted cage having a bottom wall received in the recess, a temperature responsive snap acting disc disposed on the bottom wall of the cage, a first pin slidable received in the bore between the movable switch means and the disc, an annular pressure disc support having a bore therethrough and a pressure responsive disc disposed contiguous to the annular pressure disc support, a second pin disposed in the bore of the annular pressure disc support between the bottom wall of the cage and the pressure responsive disc and means to mount the switch to a body whose temperature is to be monitored and in communication with a pressure source whose pressure is to be monitored.

15. An electric switch according to claim 14 in which the cage includes retaining means to retain the temperature responsive disc in the cage.

16. An electric switch according to claim 14 in which arms extend upwardly from the pressure disc support to define a path of movement for the cage and improve thermal coupling between the disc support and the cage.

* * * * *